US007100694B2

(12) United States Patent
Legras et al.

(10) Patent No.: US 7,100,694 B2
(45) Date of Patent: Sep. 5, 2006

(54) MARINE RISER TOWER

(75) Inventors: Jean-Luc Bernard Legras, Houston, TX (US); Grégoire François Christian De Roux, Paris (FR); Tegwen Bertrand Marie Miorcec De Kerdanet, Paris (FR)

(73) Assignee: Stolt Offshore S.A., (FR)

( * ) Notice: Subject to any disclaimer, the term of this patent is extended or adjusted under 35 U.S.C. 154(b) by 0 days.

(21) Appl. No.: 10/465,970

(22) PCT Filed: Jan. 8, 2002

(86) PCT No.: PCT/EP02/00514

§ 371 (c)(1),
(2), (4) Date: Nov. 6, 2003

(87) PCT Pub. No.: WO02/063128

PCT Pub. Date: Aug. 15, 2002

(65) Prior Publication Data

US 2004/0076478 A1 Apr. 22, 2004

(30) Foreign Application Priority Data

Jan. 8, 2001 (GB) ..... 0100414.2
Feb. 7, 2001 (GB) ..... 0103020.4
Oct. 16, 2001 (GB) ..... 0124802.0

(51) Int. Cl.
*E21B 29/12* (2006.01)

(52) U.S. Cl. ..... 166/350; 166/367; 405/224.4

(58) Field of Classification Search ..... 166/350, 166/351, 352, 367; 405/224.2, 224.3, 224.4
See application file for complete search history.

(56) References Cited

U.S. PATENT DOCUMENTS

| | | | | |
|---|---|---|---|---|
| 3,140,744 | A | 7/1964 | Bailly | 166/61 |
| 3,425,453 | A * | 2/1969 | Fuller | 138/111 |
| 3,517,110 | A * | 6/1970 | Morgan | 174/47 |
| 3,526,086 | A * | 9/1970 | Morgan | 138/111 |
| 3,747,632 | A * | 7/1973 | Kok et al. | 137/375 |
| 3,777,502 | A * | 12/1973 | Michie et al. | 62/50.7 |
| 4,332,509 | A * | 6/1982 | Reynard et al. | 405/168.1 |
| 4,401,164 | A | 8/1983 | Baugh | 166/379 |
| 4,809,952 | A * | 3/1989 | Joubert et al. | 254/29 A |
| 4,941,773 | A * | 7/1990 | Vergouw | 405/157 |
| 4,963,420 | A | 10/1990 | Jarrin et al. | 428/36.9 |
| 5,085,275 | A | 2/1992 | Gondouin | 166/303 |
| 5,330,294 | A | 7/1994 | Guesnon | 405/224 |
| 5,813,106 | A * | 9/1998 | Haug et al. | 29/429 |
| 6,082,391 | A * | 7/2000 | Thiebaud et al. | 137/236.1 |
| 6,102,077 | A * | 8/2000 | Legallais et al. | 138/115 |

(Continued)

FOREIGN PATENT DOCUMENTS

DE 19727493 A1 1/1999

(Continued)

OTHER PUBLICATIONS

"Pipelines and Risers" by Bai, Elsevier Ocean Engineering book Series, vol. 3, 2001, pp. 451-453.

*Primary Examiner*—Thomas A Beach
(74) *Attorney, Agent, or Firm*—Sheridan Ross P.C.

(57) ABSTRACT

The invention relates to a marine riser tower having a plurality of rigid metallic conduits bundled together with a metallic tubular core. The conduits may include production lines for hydrocarbons, water injection lines, and/or gas lift lines. A production line or gas lift line is located within the core, while the water injection line is located outside the core.

15 Claims, 6 Drawing Sheets

U.S. PATENT DOCUMENTS 6,267,537 B1 * 7/2001 Breivik et al. ..... 405/171

FOREIGN PATENT DOCUMENTS

| | | | |
|---|---|---|---|
| EP | 0424225 | A1 | 4/1991 |
| EP | 0467635 | A2 | 1/1992 |
| GB | 1285530 | | 8/1972 |
| GB | 2326166 | | 12/1998 |
| GB | 2337542 | | 11/1999 |
| GB | 2346188 | | 8/2000 |
| GB | 2351301 | | 12/2000 |
| WO | WO 92/19903 | | 11/1992 |
| WO | WO 99/57413 | | 11/1999 |
| WO | WO 00/40886 | | 7/2000 |
| WO | WO 01/14687 | | 3/2001 |
| WO | WO 02/12776 | | 2/2002 |
| WO | 2063128 | * | 8/2002 |

* cited by examiner

MARINE RISER TOWER

INTRODUCTION

The present invention relates to a marine riser tower, of the type used in the transport of hydrocarbon fluids (gas and/or oil) from offshore wells. The riser tower typically includes a number of conduits for the transport of fluids and different conduits within the riser tower are used to carry the hot production fluids and the injection fluids which are usually colder.

The tower may form part of a so-called hybrid riser, having an upper and/or lower portions ("jumpers") made of flexible conduit U.S. Pat. No. 6,082,391 proposes a particular Hybrid Riser Tower consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background is to be published in a paper *Hybrid Riser Tower: from Functional Specification to Cost per Unit Length* by J-F Saint-Marcoux and M Rochereau, DOT XIII Rio de Janeiro, 18 Oct. 2001.

Deepwater and Ultra-deepwater field developments usually require stringent thermal insulation criteria which are a cost driver and consequently a design driver. The cost of insulating material in the known design is very large and therefore the diameter of the core pipe is set to the minimum. Where this central core, which has a small inertia, is connected to the top submerged buoyancy tank of the tower, high stresses develop. An expensive taper joint is necessary.

Furthermore the heat transfer from the production lines is increased by their position being closer to the surrounding very cold water.

GB-A-2346188 (2H) presents an alternative to the hybrid riser tower bundle, in particular a "concentric offset riser". The riser in this case includes a single production flowline located within an outer pipe Other lines such as gas lift, chemical injection, test, and hydraulic control lines are located in the annulus between the core and outer pipe. The main flow path of the system is provided by the central pipe, and the annular space may be filled with water or thermal insulation material. Water injection lines, which are generally equal in diameter to the flowline, are not accommodated and presumably require their own riser structure.

U.S. Pat. No. 4,332,509 (Reynard et al; Coflexip) proposes a rigid riser tower made from sections of a large-diameter rigid pipe, wherein flexible flowlines are subsequently deployed, and can be removed and replaced in case of failure. The cost of flexible flowlines must make this proposal very costly compared with the rigid metal pipes used in the Girassol riser.

The aim of the present invention is to provide a riser tower having a reliable thermal efficiency and/or greater thermal efficiency for a given overall cost. Particular embodiments of the invention aim for example to achieve heat transfer rates of less than 1 $W/m^2K$.

The invention in a first aspect provides a marine riser tower comprising a plurality of rigid metallic conduits bundled together with a metallic tubular core, the conduits including at least one production line for hydrocarbons and at least one water injection line, and wherein at least one said production line is located within the core, while the water injection line is located outside the core.

Gas lift lines may not be provided in all implementations, or may be provided separately from the unitary riser tower. Where they are provided, however, insulation for the gas lift lines may also be important. The gas lift lines are also smaller, and so may be more easily accommodated within a core structure.

Accordingly, the invention in a second aspect provides a marine riser tower comprising a plurality of rigid metallic conduits bundled together with a metallic tubular core, the conduits including at least one production line for hydrocarbons, at least one water injection line, and at least one gas lift line, and wherein at least one of said gas lift and production lines is located within the core, while the water injection line is located outside the core.

In one embodiment, at least one production line is located inside of the metallic core, whereas the water injection line(s) are located to the outside of the core.

The use of the space within the core increases the efficiency of the use of the space in the design overall, and adds to the separation between warm and cold fluids. The expense of the insulation is thereby reduced. In addition, the core of the riser can now be sized larger to reduce stresses at the top of the tower and eliminate or at least simplify the taper joint at the buoy.

The conduits in a preferred embodiment comprise at least two production lines, at least two gas lift lines and at least one water injection line.

A plurality of conduits from among the production and gas lift lines may be located within the core.

All other things being equal, the production lines together with the gas lift line and other service and heating lines that are associated with the production lines would all be located within the core, whereas other service lines and umbilicals (bundles of pipes and cables for power, control and communication) would be located to the outside of the core.

On the other hand, other design considerations are such that the core should not become too large. The typical bundle includes at least two production lines (to allow pigging while the other remains on line), and accommodating these with insulation in the core may not be practical.

Accordingly, in another embodiment, only the gas lift lines are located within the core and the production lines are located outside the core.

Each production line(s) may be provided with its own insulation. This insulation may be provided substantially by foam encasing the bundle as a whole, by a coating or pipe-in-pipe insulation applied to the production line itself, or by a combination of both.

The bundle of conduits may still be encased along at least part of its length within buoyant foam material, as in the known design.

As in the known design, the buoyant foam material extends the full height of the tower, and forms the primary means of insulation for at least some of the lines.

In an alternative embodiment, buoyant material encasing the bundle of conduits may be provided only at certain spaced sections along the length of the tower, not forming the primary means of insulating the production line(s). This again reduces the cost associated with the buoyant material, by separating the functions of buoyancy and insulation. The varying profile of the tower also contributes to reduced vortex-induced vibration in the presence of currents within the seawater.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
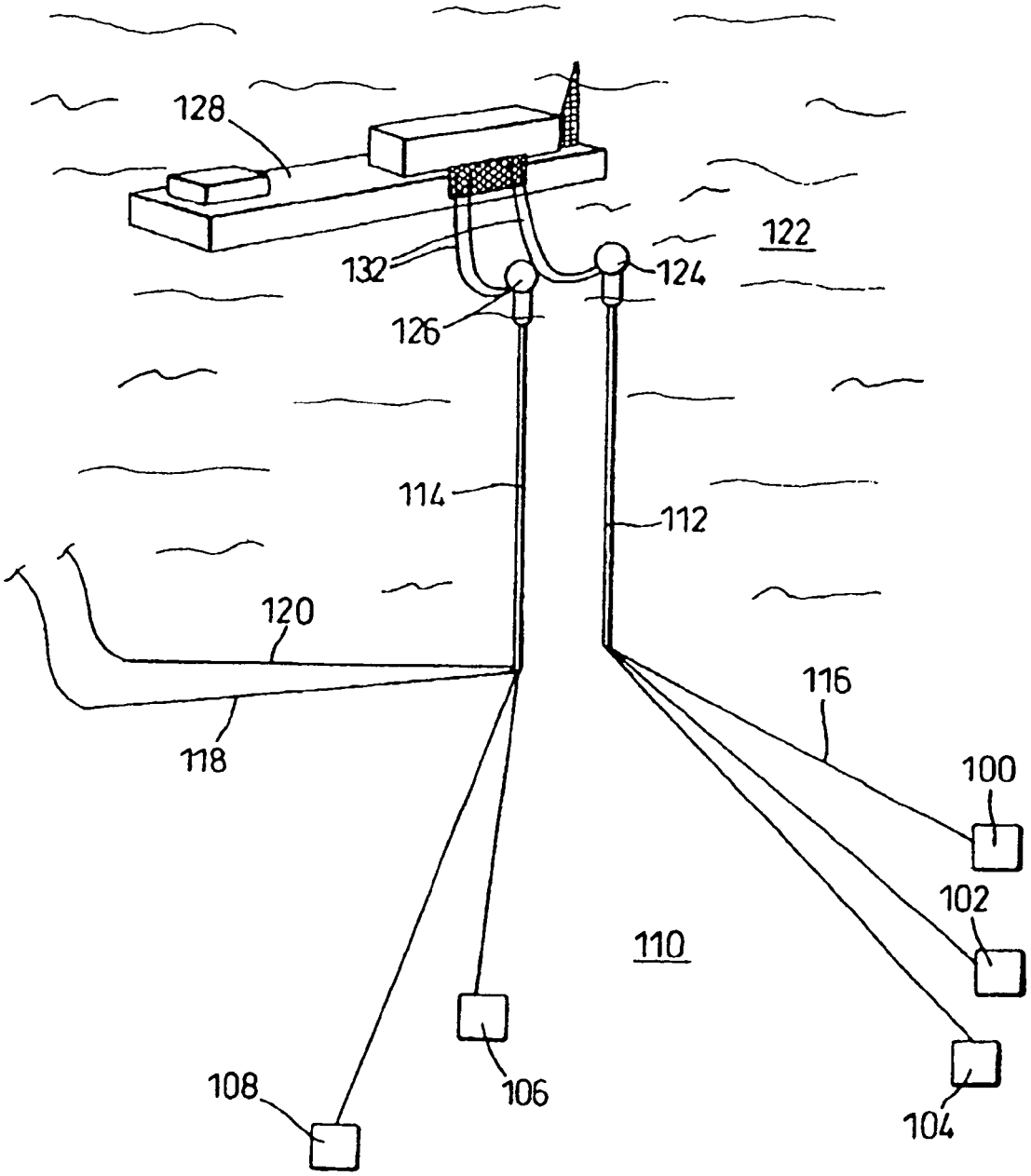
FIG. 1 illustrates schematically a deepwater installation including a floating production and storage vessel and rigid pipeline riser bundles in a deepwater oil field.

Referring to FIG. 1, the person skilled in the art will recognise a cut-away view of a seabed installation comprising a number of well heads, manifolds and other pipeline equipment 100 to 108. These are located in an oil field on the seabed 110.

Vertical riser towers constructed according to the present invention are provided at 112 and 114, for conveying production fluids to the surface, and for conveying lifting gas, injection water and treatment chemicals such as methanol from the surface to the seabed. The foot of each riser, 112, 114, is connected to a number of well heads/injection sites 100 to 108 by horizontal pipelines 116 etc.

Further pipelines 118, 120 may link to other well sites at a remote part of the seabed. At the sea surface 122, the top of each riser tower is supported by a buoy 124, 126. These towers are pre-fabricated at shore facilities, towed to their operating location and then installed to the seabed with anchors at the bottom and buoyancy at the top.

A floating production and storage vessel (FPSO) 128 is moored by means not shown, or otherwise held in place at the surface. FPSO 128 provides production facilities, storage and accommodation for the wells 100 to 108. FPSO 128 is connected to the risers by flexible flow lines 132 etc., for the transfer of fluids between the FPSO and the seabed, via risers 112 and 114.

As mentioned above, individual pipelines may be required not only for hydrocarbons produced from the seabed wells, but also for various auxiliary fluids, which assist in the production and/or maintenance of the seabed installation. For the sake of convenience, a number of pipelines carrying either the same or a number of different types of fluid are grouped in "bundles", and the risers 112, and 114 in this embodiment comprise bundles of conduits for production fluids, lifting gas, injection water, and treatment chemicals, methanol.

As is well known, efficient thermal insulation is required around the horizontal and vertical flowlines, to prevent the hot production fluids cooling, thickening and even solidifying before they are recovered to the surface.

Figure 2:
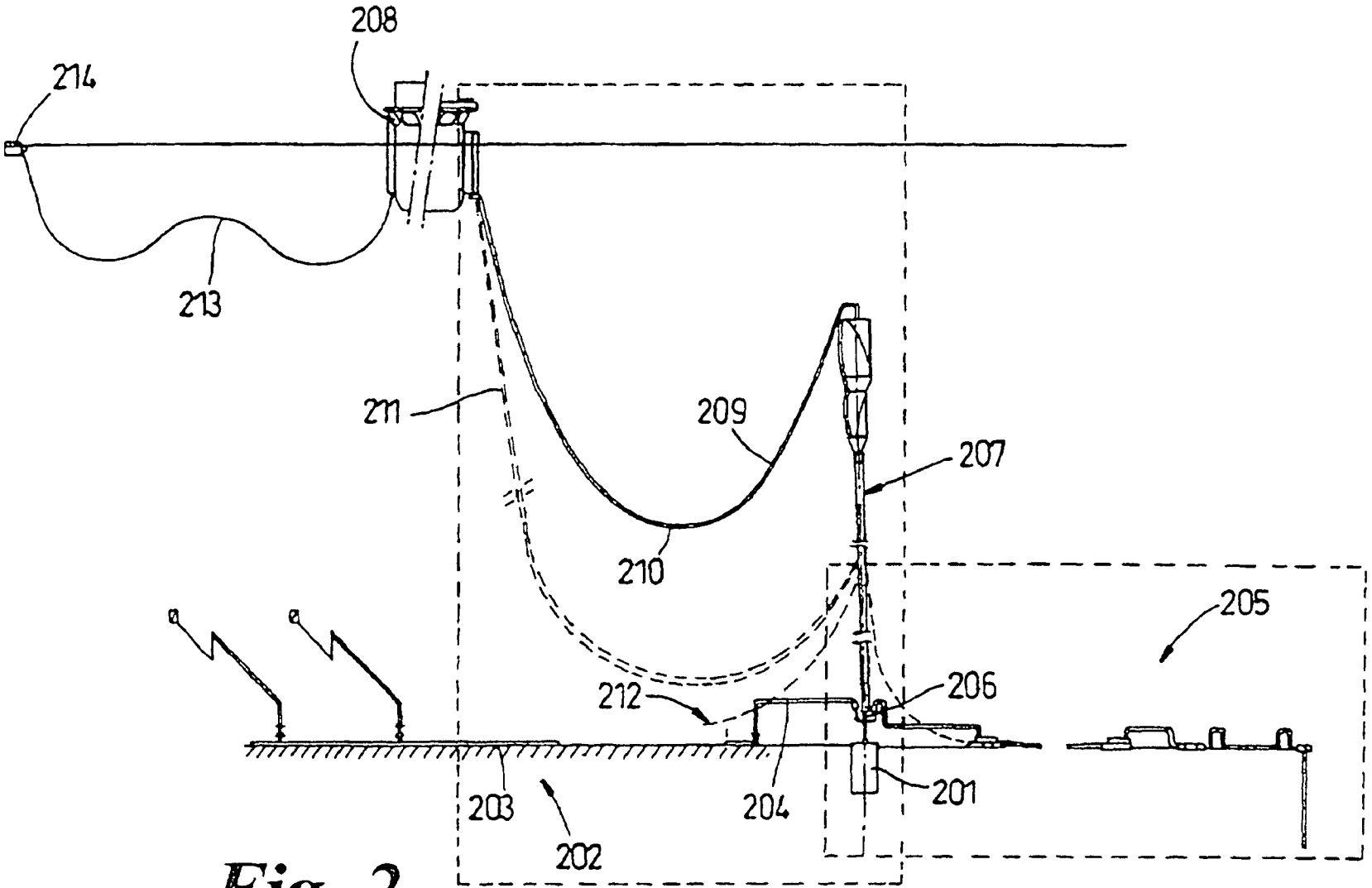
FIG. 2 is a more detailed side elevation of an installation of the type shown in FIG. 1 including a riser tower according to a first embodiment of the present invention.

Now referring to FIG. 2 of the drawings, there is shown in more detail a specific example of a hybrid riser tower installation as broadly illustrated in FIG. 1.

The seabed installation includes a well head 201, a production system 205 and an injection system 202. The injection system includes an injection line 203, and a riser injection spool 204. The well head 201 includes riser connection means 206 with a riser tower 207, connected thereto. The riser tower may extend for example 1200 m from the seabed almost to the sea surface. An FPSO 208 located at the surface is connected via a flexible jumper 209 and a dynamic jumper bundle 210 to the riser tower 207, at or near the end of the riser tower remote from the seabed. In addition the FPSO 208 is connected via a dynamic (production and injection) umbilical 211 to the riser tower 207 at a point towards the mid-height of the tower. Static injection and production umbilicals 212 connects the riser tower 207 to the injection system 202 and production system 205 at the seabed.

The FPSO 208 is connected by a buoyancy-aided export line 213 to a dynamic buoy 214, the export line 213 being connected to the FPSO by a flex joint 215.

Figure 3:
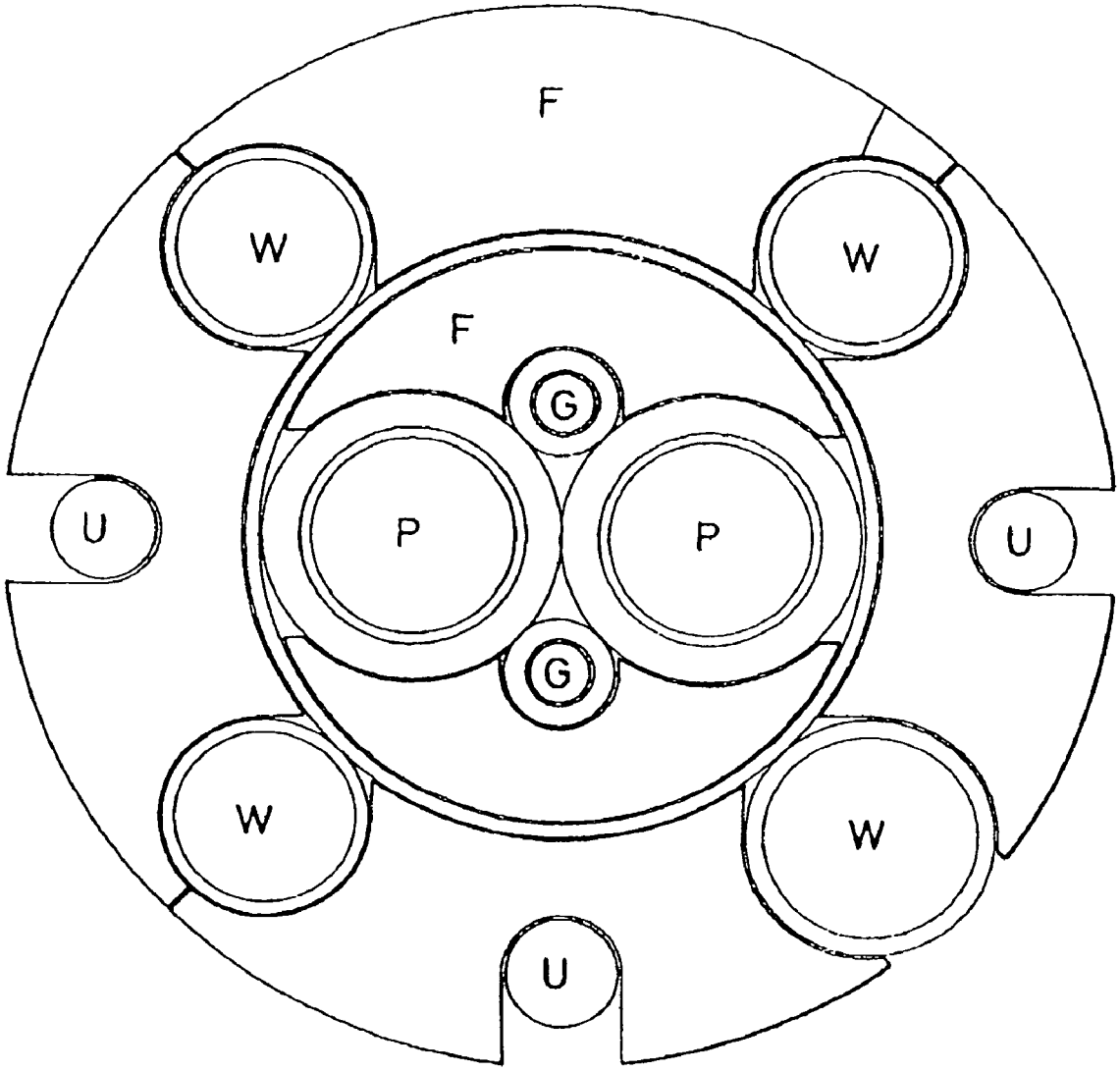
FIG. 3 is a cross-sectional view of the riser tower in the installation of FIG. 2.
Figure 4:
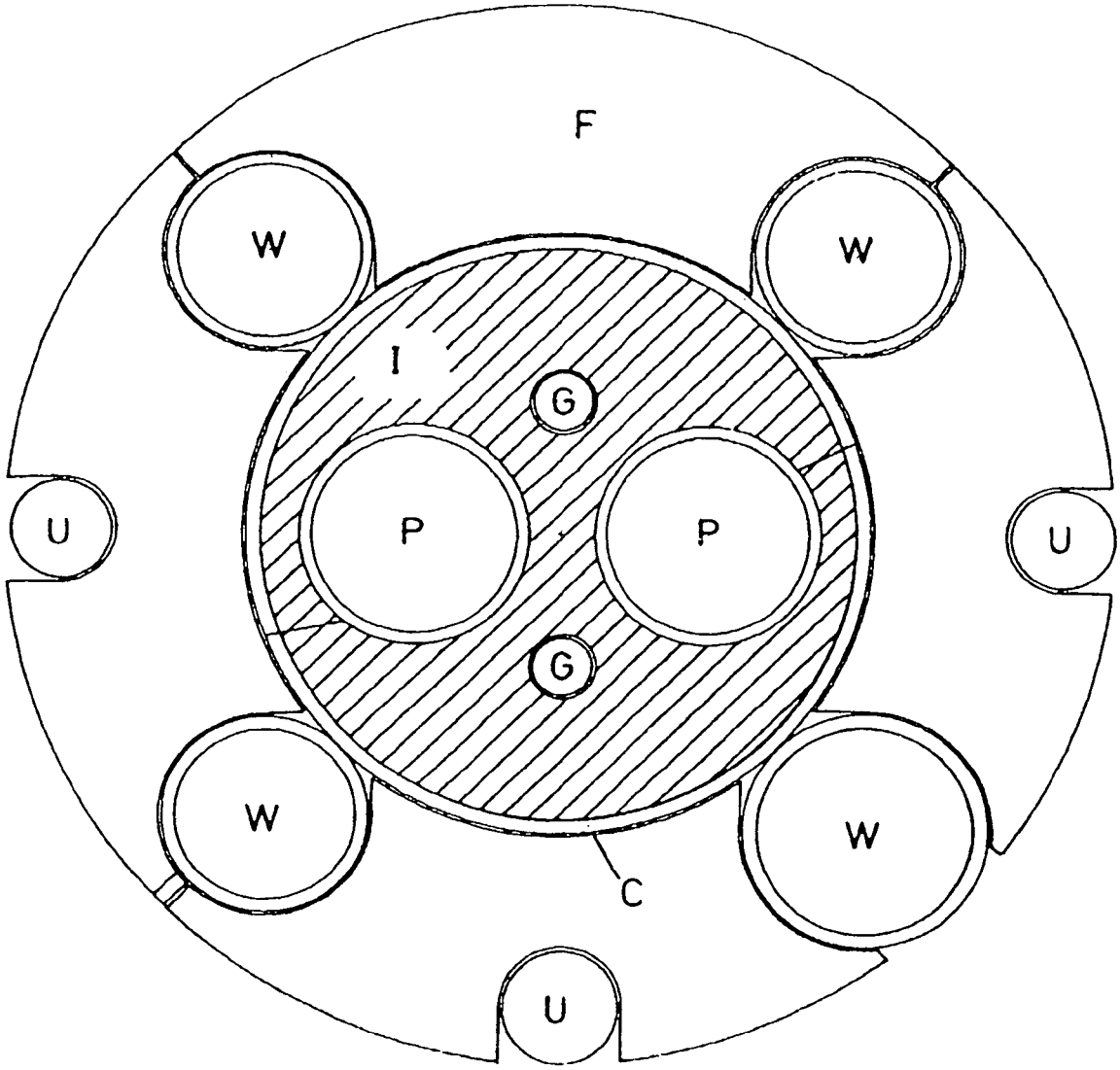
FIG. 4 is a cross-sectional view of the riser tower in a second embodiment of the invention.
Figure 5:
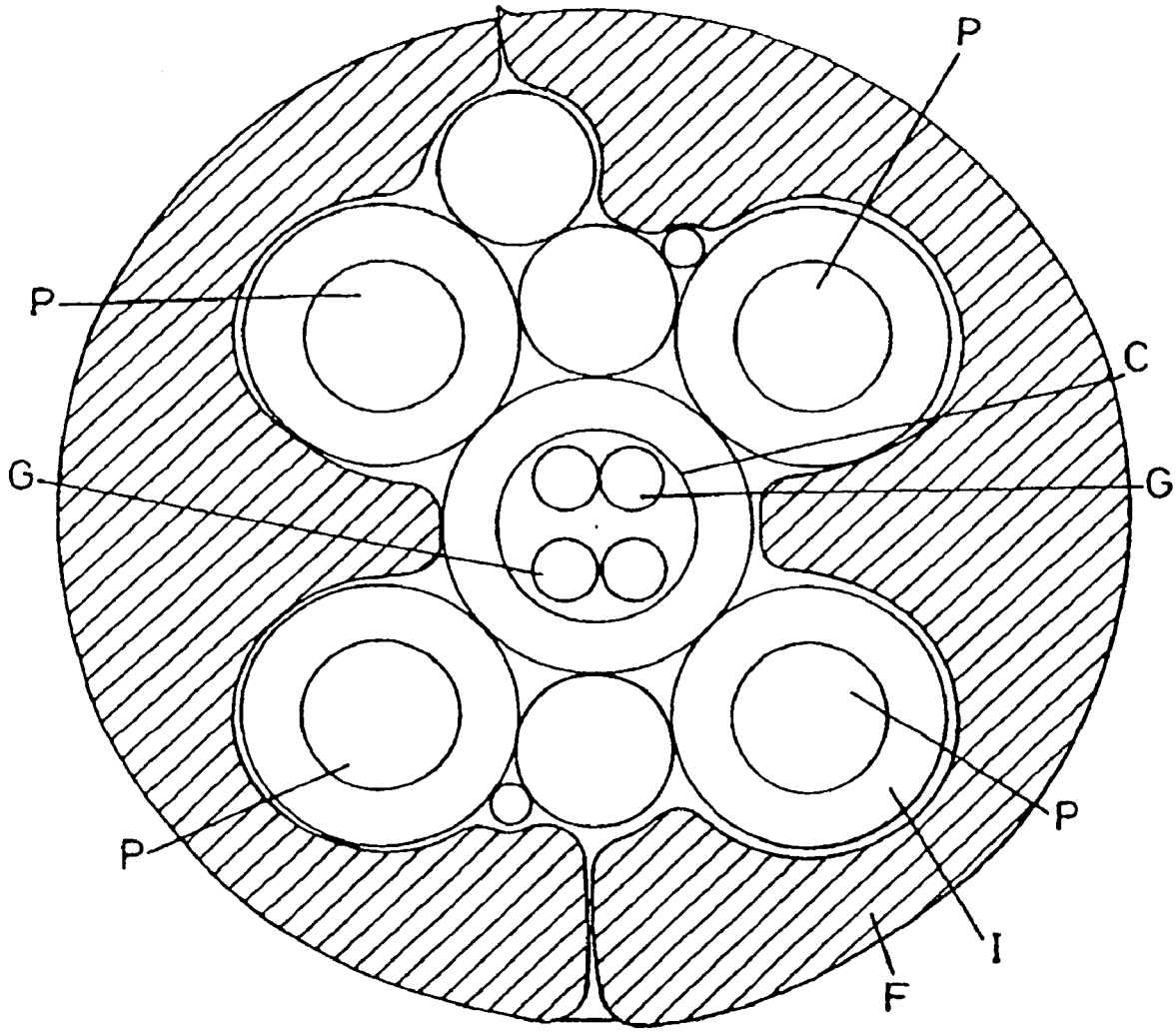
FIG. 5 is a cross-sectional view of the riser tower in a third embodiment of the invention.
Figure 6:
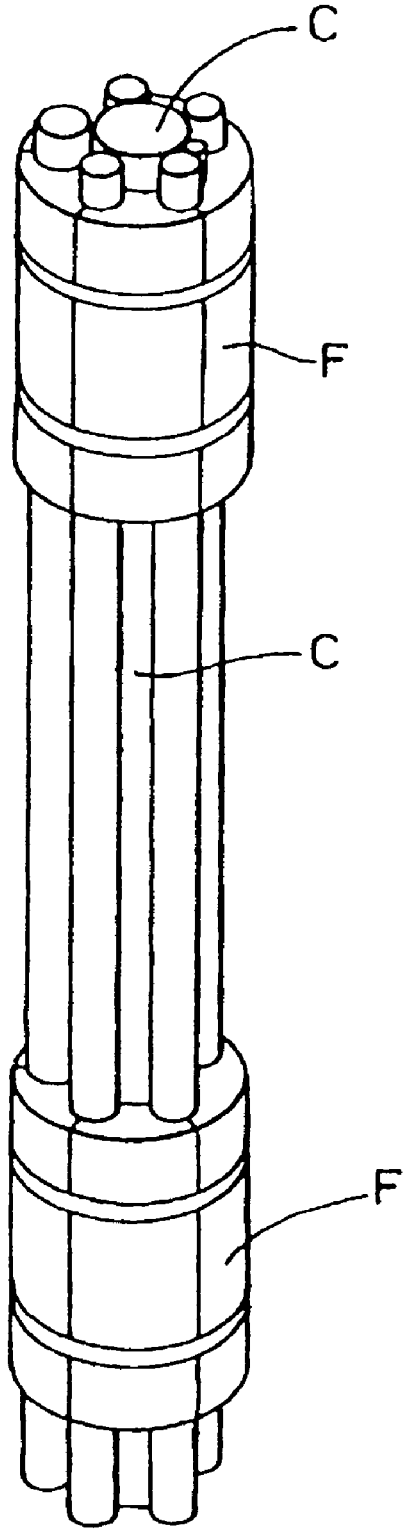
FIG. 6 illustrates a modification of the first or third embodiment, in which the foam blocks extend only over parts of the tower's length.

FIGS. 3 to 5 show in cross-section respective embodiments of the a riser tower such as 112 or 114. Within these examples, the central metallic core pipe is designated C. Within the core are production flowlines P and gas lift lines G. Outside the core are water injection lines W and umbilicals U. Major interstices are filled with shaped blocks F of syntactic foam or the like. The designations C, P, W, G, F and U are used throughout the description and drawings with the same meaning. The designation I will also be used for insulating coatings.

In FIG. 3 of the drawings there is shown a construction of riser having a hollow core pipe C. Located within the core pipe are two production lines P and two gas lift lines G and located outside the core pipe are four water injection lines W and three umbilicals U. The production lines P have their own insulating coating I. The spaces between the line both internally and externally of the core pipe P are filled with blocks F of syntactic foam that are shaped to meet the specific design requirements for the system It should be noted that in this example the foam blocks externally located about the core pipe C have been split diametrically to fit around the core between the water injection lines, which do not themselves require substantial insulation from the environment There are no insulated lines within the foam outside the core, and no circumferential gaps between the foam blocks, such as would be required to insulate production and gas lift lines located outside the core.

Production flowlines P in this example also carry their own insulation, being coated with a polypropylene layer, of a type known per se, which also adds to their insulation properties. Relatively thick PP layers can be formed, for example of 50–120 mm thickness. Higher-insulated foam and other coatings can be used, as explained below.

FIG. 4 shows a second example in cross-section. In this arrangement as with the previously described arrangement located within the core pipe C are two production lines P and two gas lift lines G and located outside the core pipe are four water injection lines W and three umbilicals U. In this example foam blocks F as with the previous example are provided as insulation externally of the core pipe C. However in this example the insulation between the lines internally of the core pipe C is provided by a body of grease or paraffin (wax like) material which completely fills the space in the core pipe C. The use of the grease or wax like material in this fashion helps to prevent natural convection being established about the hot production lines. The increase the thermal efficiency of the riser design markedly and is described in more detail in our co-pending patent application PCT/EP01/09575 (Agents' Ref 63639WO), not published at the present priority date.

Both of the above examples accommodate all of the temperature-critical lines within the core, and all of the water lines outside it. This has the highest thermal efficiency, but will not always be possible in view of the number and size of the production lines, and other design considerations.

FIG. 5 of the drawings shows a third example in which only the gas lift lines G are located in the core pipe C, and the production lines P are located externally of the core pipe C with the water injection lines W and umbilicals U. The figure shows the use of foam insulation F internally of the core pipe C but it will be appreciated that the use of grease or wax like material insulation is another options. In this example, since the production lines P are closer to the environment and to the water lines, they are provided with enhanced insulation I such as PUR or other foam. Pipe-in-pipe insulation (essentially a double-walled construction) is also possible here.

In other examples, the foam blocks F may also be shaped so as to surround the production lines. The co-pending patent application PCT/EP01/09575, mentioned above., also discloses the use of grease to prevent convention currents in the gaps between foam blocks F, should that be necessary Of course the specific combinations and types of conduit are presented by way of example only, and the actual provisions will be determined by the operational requirements of each installation. The skilled reader will readily appreciate how the design of the installation at top and bottom of the riser tower can be adapted from the prior art, including U.S. Pat. No. 6,082,391, mentioned above, and these are not discussed in further detail herein As explained above, the present disclosure proposes to use the empty space within the core C to locate temperature sensitive lines such as the hot production flowlines P or gas lift lines G. The central core pipe C can be either open at its bottom end or closed. Closure could be achieved with bulkhead plates at top and bottom.

The generic advantages of accommodating some lines in the central core are:

The core diameter is increased which allows a direct connection to the buoy without taper joint;

The central core does not require to be designed for collapse

The hot area of the tower is reduced which minuses heat losses to surrounding seawater;

Active heating, that can be provided either with hot water piping or electrical cables, benefits from the insulation within the tubular core member;

Monitoring of the central core temperature and pressure can be provided.

The arrangement shown in FIG. 3 may have the metallic core C open to the bottom. Advantages specific to a central core open at bottom are:

The central core section can receive different types of insulation material, and/or also convection-reducing material such as, but not limited to, high viscosity oil, gels, grease, paraffins or granular materials, all with or without a filler such as open cell foam or glass beads (the use of grease and paraffin materials is proposed in our co-pending applications GB0018999.3 and PCT/EP01/09575, not published at the present priority date);

The example shown in FIG. 4 shows a "dry" embodiment that would also include a top and bottom bulkhead. Advantages of a central core C, with top and bottom bulkheads, and which is designed for collapse are:

The central section may be filled with ambient pressure high insulation material I such as PUR foam or microporous aerogels;

Reduced pressure can be applied inside of the core either for buoyancy and/or insulation enhancement of the above material;

The central section may alternatively receive pipes which are directly coated with highly insulated material such as, PUR foam or microporous material (this is subject of our co-pending applications GB0100413.4 and 0103020.4 and 0124801.2 (63752GB, GB2 and GB3).

The invention claimed is:

1. A marine riser tower comprising a plurality of rigid metallic conduits bundled together with a metallic tubular core, the conduits including at least one production line for hydrocarbons and at least one water injection line, wherein at least one said production line is located within the core, while the water injection line is located outside the core, and wherein the conduits comprise at least two production lines, at least two gas lift lines and at least one water injection line.

2. A marine riser tower comprising a plurality of rigid metallic conduits bundled together with a metallic tubular core, the conduits including at least one production line for hydrocarbons, at least one water injection line, and at least one gas lift line, and wherein at least one of said gas lift and production lines is located within the core, while the water injection line is located outside the core.

3. A marine riser as claimed in claim 2, further including a plurality of production lines and gas lift lines and wherein a plurality of conduits from among the production and gas lift lines are located within the core.

4. A marine riser as claimed in claim 2, wherein only the at least one gas lift line is located within the core and the at least one production line is located outside the core.

5. A marine riser as claimed in claim 1 wherein the production line(s) is provided with its own insulation.

6. A marine riser as claimed in claim 5, wherein the insulation is provided substantially by foam encasing the bundled conduits as a whole, the insulation being a coating or pipe-in-pipe insulation applied to the at least one production line itself, or by a combination thereof.

7. A marine riser as claimed in claim 1 wherein the bundle of conduits is encased along at least part of its length within buoyant foam material.

8. A marine riser as claimed in claim 7 wherein the buoyant foam material extends a full height of the tower, and forms a primary means of insulation for at least some of the lines.

9. A marine riser as claimed in claim 7 wherein the buoyant material encasing the bundle of conduits is provided at spaced sections along the length of the tower.

10. A marine riser as claimed in claim 2, wherein the at least one production line is located inside of the metallic core, and the at least one water injection line is located outside of the core.

11. A marine riser as claimed in claim 2 wherein the conduits comprise at least two production lines, at least two gas lift lines and at least one water injection line.

12. A marine riser as claimed in claim 2 wherein a plurality of conduits from among the production and gas lift lines are located within the core.

13. A marine riser as claimed in claim 2, wherein only the at least one gas lift line is located within the core and the at least one production line is located outside the core.

14. A marine riser as claimed in claim 2 wherein the at least one production line is provided with its own insulation.

15. A marine riser as claimed in claim 2 wherein the bundle of conduits is encased along at least part of its length within buoyant foam material.

* * * * *